United States Patent [19]

Pfitzenmaier

[11] 4,167,713

[45] Sep. 11, 1979

[54] MICROWAVE FILTER EMPLOYING A THEORETICAL MINIMUM NUMBER OF COUPLINGS

[75] Inventor: Gerhard Pfitzenmaier, Munich, Fed. Rep. of Germany

[73] Assignee: Siemens Aktiengesellschaft, Berlin & Munich, Fed. Rep. of Germany

[21] Appl. No.: 855,891

[22] Filed: Nov. 30, 1977

[30] Foreign Application Priority Data

Dec. 20, 1976 [DE] Fed. Rep. of Germany ..... 2657649

[51] Int. Cl.[2] ..... H01P 1/20; H01P 7/06

[52] U.S. Cl. ..... 333/212; 333/227

[58] Field of Search ..... 333/73 R, 73 C, 73 S, 333/73 W, 83 R; 29/600, 601

[56] References Cited

FOREIGN PATENT DOCUMENTS 2511800 9/1976 Fed. Rep. of Germany .

*Primary Examiner*—Alfred E. Smith
*Assistant Examiner*—Harry E. Barlow
*Attorney, Agent, or Firm*—Hill, Van Santen, Steadman, Chiara & Simpson

[57] ABSTRACT

A filter for very short electromagnetic waves having a plurality of resonators which are coupled to one another and which are operated in the dualmode. The first and last resonators, as viewed in the direction of energy transmission, are provided with connection lines for the supply and discharge of electromagnetic energy. An additional coupling is provided between at least two filter circuits which are not directly consecutive in the electrical mode of operation and the individual resonators are arranged in juxtaposed rows. The resonators are arranged to be mechanically symmetrical relative to the center of the circuit, and the equivalent circuit diagram on which the construction is based is selected to be asymmetrical in respect of the element values, in such a manner that the number of additional couplings agrees with the theoretically determined, minimum number of additional couplings. The filter may be designed as a transit-time leveled band pass filter having two attenuation poles at finite frequencies in each case above and below the pass band and in which the resonators are arranged in two juxtaposed rows each of which contains three resonators and wherein either four or five additional couplings are provided.

4 Claims, 6 Drawing Figures

MICROWAVE FILTER EMPLOYING A THEORETICAL MINIMUM NUMBER OF COUPLINGS

BACKGROUND OF THE INVENTION

1. Field of the Invention

The present invention relates to a filter for very short electromagnetic waves and comprises a plurality of resonators which are coupled to one another and which are operated in the dual mode, whose first and last resonators, as viewed in the direction of energy transmission, are provided with connection lines for the supply and discharge of electromagnetic energy, and more particularly to such a filter in which an additional coupling is provided between at least two filter circuits which are not directly consecutive in the electrical mode of operation and in which the individual resonators are arranged in juxtaposed rows.

2. Description of the Prior Art

In the microwave technique it is well known to construct filters from a plurality of microwave resonators which are coupled to one another, the coupling being effected either capacitively or inductively. The resonators themselves can comprise, for example, so-called coaxial line resonators or wave guide resonators.

In contrast to filters constructed with concentrated switching elements, because of the geometrically predetermined configuration of the resonators, it is not possible to readily transfer every circuit which can be constructed in the concentrated technique to the microwave frequency range. This difficulty occurs, in particular, when it is necssary to produce attenuation poles in the attenuation characteristic of the filter, and/or to effect a leveling of transit time in the pass band of the filter by means of additional couplings of filter circuits. This difficulty is eliminated by the arrangement disclosed in the German published application No. 1,942,867, of the resonators in neighboring rows having additional over-couplings in the common partition wall of two resonators which are arranged in different rows.

The possibility of constructing microwave filters with cavity resonators which are simultaneously operated in more than one mode is also known. For example, one may take reference to the article entitled "Microwave Filters Employing a Single Cavity Excited in More Than One Mode", published in the "Journal of Applied Physics", Vol. 22, No. 8, August 1951, by Wei-Gaun Lin, and to the article by A. E. Williams entitled "A Four Cavity Elliptic Waveguide Filter", published in the "IEEE Transactions on Microwave Theory Techniques", Vol. MTT. 18, No. 12, December 1970. Here, preferably two identical, but orthogonal modes, are employed in $H_{101}$ resonators or $H_{111}$ resonators, and are coupled to one another by a coupling screw arranged at 45° to the direction of the E vectors (dual mode). In this manner, two electric oscillating circuits of a filter can be constructed in a single cavity resonator in a technically effective manner. Because of the saving in respect of weight and volume up to 50% which can be achieved in dual mode operation, an important sphere of application resides, in particular, in satellite technology, particularly as the filters employed therein are subject to high electric requirements which is manifest in a relatively large number of electric oscillating circuits.

Since these filters also require attenuation poles and/or a leveling of the transit time in the pass band, it is highly desirable to provide suitable filter circuits in the dual mode technique. In this context, a proposed realization is already known from the article of A. E. Atia and A. E. Williams entitled "Nonminimum-Phase Optimum-Amplitude Bandpass Waveguide Filters", published in the "IEEE Transactions on Microwave Theory and Techniques", Vol. MTT-22, No. 4, April 1974, which, however, is restricted to filter circuits which are symmetrical, both in respect of structure and in respect of element values, and which furthermore possess frequently overlapping, additional couplings whose number and geometric position within the filter arrangement cannot be preselected, and the number of electric oscillating circuits of which must amount to a multiple of four, as a result of which this proposal frequently cannot be put into practice. A prerequisite of the construction of filters with additional couplings in the dual mode technique is, in fact, a resonator arrangement which permits a correct-sign realization of all couplings.

A possibility of improving the ability to realize filter circuits which are asymmetrical, in particular in respect of element values, and which are operable in the dual mode has been disclosed in the German published application No. 2,511,800 and resides in arranging the resonators in neighboring rows, and providing a different number of resonators in the rows.

SUMMARY OF THE INVENTION

The coupling of filter circuits in resonators which differ spatially is conditional upon the relevant two filter circuits being spatially identically oriented, so that, for example, the E vectors thereof extend parallel to one another. Since this condition restricts the number of theoretically conceivable couplings, and thus the spectrum of possible realizations, or permits realizations only at the expense of fundamentally desirable additional couplings, or with production disadvantages, the object of the invention is to overcome these difficulties in a simple manner and to provide a further realization of filter circuits having resonators operated in the dual mode and additional couplings, by means of which the disadvantages of the known arrangements are avoided and the spectrum of possible realizations is simultaneously extended.

Beginning from a filter for very short electromagnetic waves, which comprises a plurality of resonators which are coupled to one another and operated in the dual mode, and in which the first and last resonators, considered in the direction of energy to be transmitted, are provided with connection lines for the supply and discharge of the electromagnetic energy, and wherein an additional coupling is provided between at least two filter circuits which are not directly consecutive in the electrical mode of operation, and the individual resonators are arranged in juxtaposed rows, the above object is achieved in that the resonators are arranged to be mechanically symmetrical relative to the center of the circuit, and that the equivalent circuit diagram on which the arrangement is based is selected to be asymmetrical in respect to the element values, in such a way that the number of additional couplings is identical to the theoretically determined, minimum number of additional couplings.

The present invention is based on the recognition that it is possible to construct a filter in the dual mode technique with the minimum number of additional couplings already provided in the filter design, by basing a mechanically symmetrical resonator arrangement upon an equivalent circuit diagram which is asymmetrical in respect of the element values.

A particular advantage of the invention resides in the fact that the limitations regarding the possibility of constructing complicated circuit structures which exist in known filters of this type are considerably reduced.

Further advantages are attained by means of the reduced number of additional couplings required for the arrangement, and the resultant substantial simplification of production and tuning of the filters according to the invention.

An advantageous embodiment of the invention resides in a filter designed as a transit-time leveled, twelve-circuit band pass filter having two attenuation poles at finite frequencies, in each case below and above the pass band, wherein the resonators are arranged in two rows which are, in each case, next to one another and each contain three resonators, and wherein five additional couplings are provided.

A further advantageous embodiment of the invention has four additional couplings and will be discussed in detail below.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
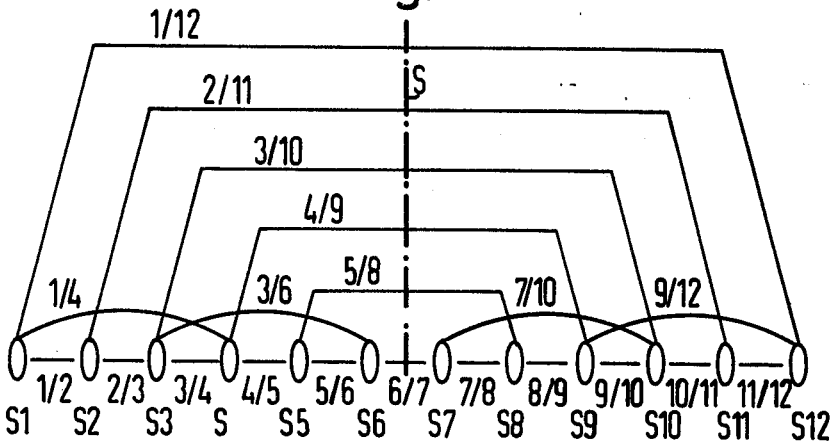
Fig. 1 (PRIOR ART)
FIG. 1 is an equivalent circuit diagram illustration, which is symmetrical in respect of structure and elements, of a twelve-circuit dual mode band pass filter.

Referring to FIG. 1, an equivalent circuit diagram is illustrated for a filter which is symmetrical in respect of structure and elements, the filter being a twelve-circuit dual mode band pass filter which is known, for example, from the above-identified article of Atia and Williams.

The circuit in FIG. 1 is a four-pole circuit which has, in its shunt arms, parallel oscillating circuits S1–S12, symbolically illustrated as ellipsis, and couplings which are effected by way of coupling reactances 1/2, 2/3 . . . 11/12, which are represented as simple line connections and which are located in the series arms of the circuit. By way of additional couplings, coupling reactances 1/12, 2/11, 3/10, 4/9 and 5/8 have been introduced which symmetrically overlap the center of the circuit, and coupling reactances 1/4, 3/6, 7/10 and 9/12 have been introduced which, although likewise symmetrical to the center of the circuit, do not extend across the center of the circuit. In FIG. 1 these coupling reactances have likewise been represented as simple line connections extending between the relevant parallel oscillating circuits and have been provided with references composed of the symbols for the contacted parallel oscillating circuits and an interposed oblique line. The line of symmetry which passes through the center of the circuit and which is electrical, and, in the case of known circuits which correspond to FIG. 2, also mechanical, is represented in FIG. 1 as a dot-dash broken line S. For reasons of symmetry, this circuit diagram is subject to the requirement for the coupling bandwidths:

$$\Delta f_{1\cdot4}=f_{9\cdot12}$$

$$\Delta f_{3\cdot6}=f_{7\cdot10}$$

Figure 2:
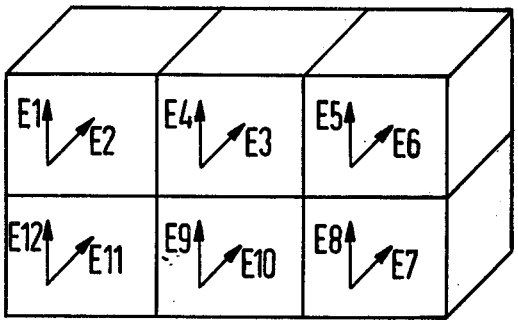
Fig.2 (PRIOR ART)
FIG. 2 is a diagram of a known resonator arrangement of a filter which corresponds to the equivalent circuit diagram of FIG. 1.

The filter structure which is associated with the circuit illustrated in FIG. 1 and which is achieved, for example, by means of $H_{101}$ resonators is schematically illustrated in FIG. 2. Here, the correct-sign coupling of the filter circuits is effected in a known manner by a suitable positioning of the dual mode coupling screws (not separately illustrated) within a resonator, and by coupling slots in the common partition walls between neighboring resonators. The mechanically symmetrical resonator arrangement, which is constructed in two neighboring rows with, in each case, three resonators, is supplemented in FIG. 2 by the arrows E1–E12 which each indicate the position of the E vectors of the corresponding filter circuits S1–S12. With this type of construction of a twelve-circuit band pass filter, however, nine additional couplings arranged in the common partition walls of the resonators are required, which necessitates a substantial production outlay.

Figure 3:
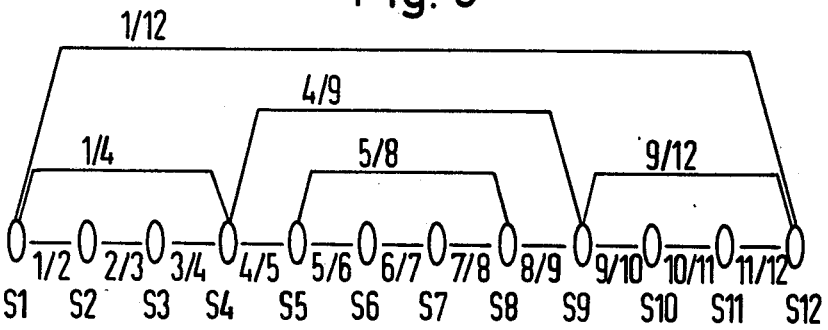
FIG. 3 is an equivalent circuit diagram of a twelve-circuit dual mode band pass filter which is symmetrical in structure but which is asymmetrical will respect to element values.

The twelve-circuit dual mode filter constructed in accordance with the present invention, and which is based on the same electrical transmission function corresponding to the equivalent circuit diagram in FIG. 1, fundamentally comprises a a mechanically symmetrical resonator arrangement which is identical to the illustration in FIG. 2; in accordance with the invention, however, the mechanically symmetrical construction has been based upon the electrically asymmetrical equivalent circuit diagram illustrated in FIG. 3.

The equivalent circuit diagram in FIG. 3, which is symmetrical in respect of structure, yet asymmetrical in respect of element values, and which is equivalent to the circuit illustrated in FIG. 1, likewise contains the parallel oscillating circuits S1–S12 which are symbolically illustrated as ellipsis, and the coupling of which is again effected via the coupling reactances 1/2, 1/3 . . . 11/12 arranged in the series arms. By way of additional couplings, there are introduced the coupling reactances 1/12, 4/9 and 5/8 which overlap the center of the circuit, and the coupling reactances 1/4 and 9/12 which are symmetrical with respect to the center of the circuit but do not overlap. The construction of an asymmetrical equivalent circuit diagram of this type, with respect to the elements, by means of a symmetrical resonator arrangement, requires four additional couplings less than the known construction corresponding to FIGS. 1 and 2. Because of the symmetry in respect of the element values, for the band pass filter of the present invention, a tuning is achieved in which the coupling band widths $\Delta f_{1\cdot4}$ and $\Delta f_{9\cdot12}$ differ from one another.

Figure 4:
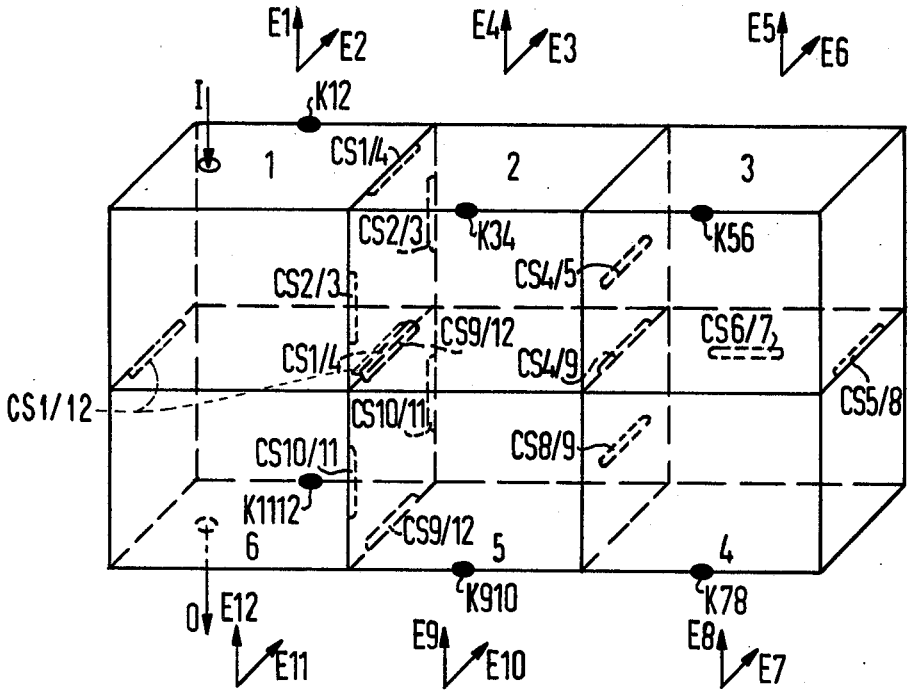
FIG. 4 is a schematic representation of an exemplary embodiment of a twelve-circuit filter constructed in accordance with the invention.

The exemplary embodiment of the invention shown in FIG. 4 illustrates a filter arrangement which comprises six cavity resonators 1–6, and the physical equivalent circuit diagram of which, as described below, is governed in principle by the circuit illustrated in FIG. 3. As in FIG. 2, the resonators 1–6 in this exemplary embodiment are distributed between two neighboring rows in such a manner that one row contains the resonators 1–3 and the other row contains the resonators 4–6, and that the resonators arranged beside one another and above one another in the two rows each have a common partition wall.

The exemplary embodiment comprises a twelve-circuit dual mode band pass filter having four additional over-couplings in order to achieve attenuation poles as finite frequencies and a transit time leveling in the pass band employing $H_{101}$ resonators. The middle frequency of the band pass filter is 4015 MHz and the signal band width $\Delta f$ amounts to 36 MHz. The exemplary embodiment corresponds to an equivalent circuit diagram as shown in FIG. 3 ($\Delta f_{1\cdot4} \neq \Delta f_{9\cdot12}$), in which all the additional over-couplings are inductive, and, with the exception of the capacitive coupling reactances 1/2 and 11/12, the other coupling reactances 2/3–10/11 arranged in the series arms are likewise inductive.

In the exemplary embodiment, the coupling elements which serve to couple the resonators operated in the dual mode are designed as slot couplings and are arranged in such a manner that the electromagnetic energy fed to the resonator 1 of the filter via an input terminal I successively passes through the resonators 1–3 of the first row and 4–6 of the second row and is coupled out at the output O of the resonator 6.

In the exemplary embodiment illustrated in FIG. 4, and in a known manner, in each case two neighboring parallel oscillating circuits of the equivalent circuit diagram in FIG. 3 are each realized by a resonator operated in the dual mode with two orthogonal modes. The E vectors assigned to the individual modes consequently are likewise orthogonal within a resonator and on the drawing are referenced in accordance with the associated parallel oscillating circuits S1–S12 with E1–E12.

Each of the resonators is provided, for the adjustment of the coupling between the orthogonal modes operated therein, with a coupling screw K12, K34, K56, K78, K910 and K1112 which is arranged between the corresponding E vectors at an angle of 45°. These screws, in each case, produce the coupling between two neighboring parallel oscillating circuits of an equivalent circuit, which are constructed in one resonator.

Furthermore, in the exemplary embodiment, the coupling elements in the common partition walls of the individual resonators are designed as slot couplings which can possibly also be replaced, at least partially, by hole couplings, in which case the couplings of the resonator 1 to the resonator 2 is effected through the coupling slots CS1/4 and CS2/3, the additional coupling 1/4 being effected through the coupling slots CS1/4 and the coupling reactance 2/3 of the equivalent circuit diagram located in the series arm being effected through the coupling slots CS2/3. In this case, the coupling always takes place between two modes whose associated E vectors are aligned in neighboring resonators and in parallel with one another, via coupling slots which are arranged at right angles to these E vectors in the common partition wall of these resonators. These considerations regarding the arrangement of the coupling slots also apply to the following resonators 2–6, with the associated E vectors E3–E12. Accordingly, the common partition wall of the resonators 2 and 3 contains the coupling slots CS4/5, the common partition wall of the resonators 3 and 4 contains the coupling slots CS6/7 and CS5/8, the common partition wall of the resonators 4 and 5 contains the coupling slots CS8/9, and the common partition wall of the resonators 5 and 6 contains the coupling slots CS9/12 and CS10/11. In the common partition wall of the resonators 2 and 5 there is also provided a coupling slot CS4/9 which extends at right angles to the E vectors E4 and E9.

The construction of the twelve-circuit dual mode filter according to the present invention requires four additional couplings less than in a known construction corresponding to FIGS. 1 and 2, and thus offers considerable advantages, both electrically and in particular from the point of view of production technology.

Figure 5:
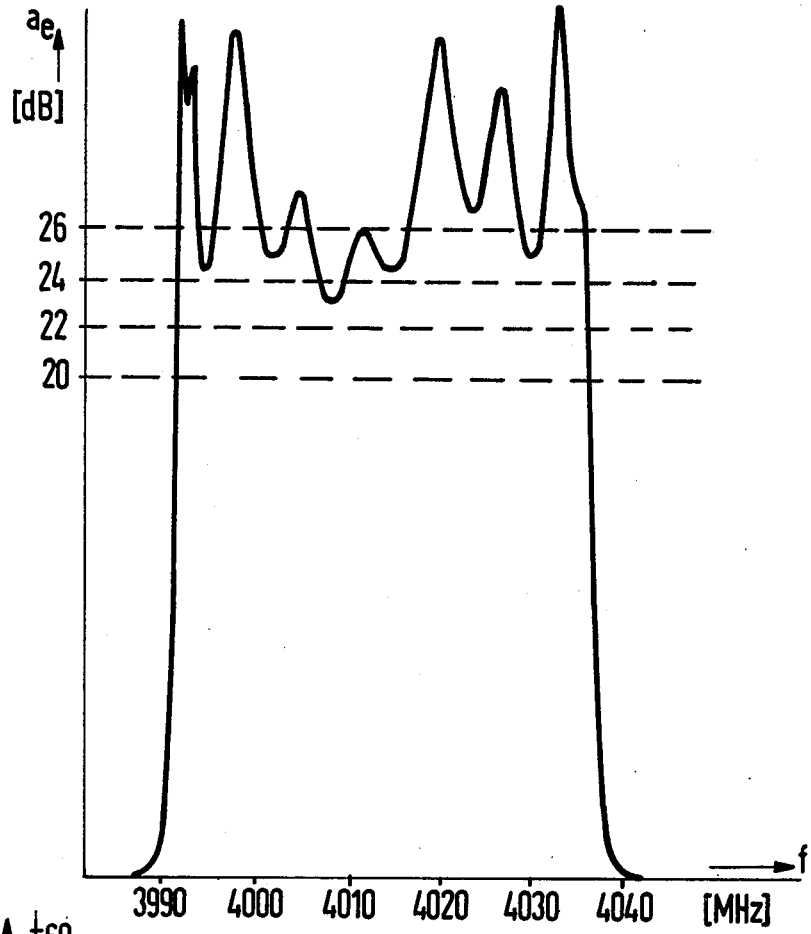
FIG. 5 is a graphic illustration of the echo attenuation of the filter of FIG. 4.

FIG. 5 illustrated a measurement curve of the echo attenuation of an exemplary embodiment as illustrated in FIG. 4. As can be seen from this drawing, within a frequency range having a width of $\Delta f = 44{\cdot}3$ MHz, the measured echo attenuation curve lies above a value of 23 dB, which correponds to a reflection factor of $\leqq 7\%$.

Figure 6:
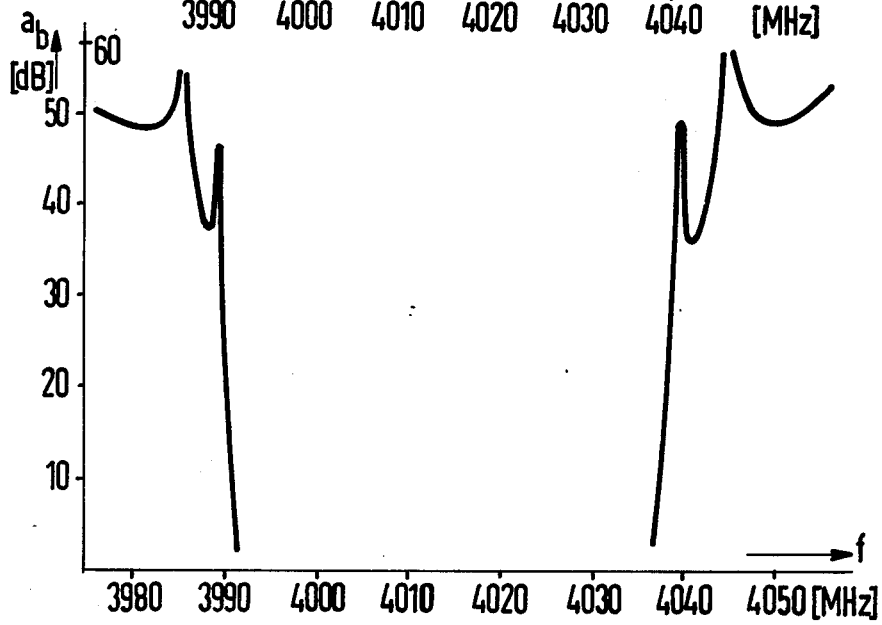
FIG. 6 is a graphic illustration of the operating attenuation of the filter illustrated in FIG. 4.

The two clearly defined poles, in each case below and above the pass band, can be seen from the measurement curve illustrated in FIG. 6 for the operating attenuation in the blocking band. Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A filter for very short electromagnetic waves, comprising: a plurality of resonators constituting a plurality of filter circuits, operated in the dual mode and coupled to one another, whose first and last resonators, respectively, are provided with connection lines for feeding electromagnetic energy in the direction of the energy to be transmitted, said filter including an additional coupling between at least two filter circuits which are not directly consecutive in the electrical mode of operation, and the individual resonators being arranged in two rows directly adjacent and respectively containing three resonators, said rows of resonators being mechanically symmetrically arranged such that the electromagnetic energy fed to the first resonator successively passes the resonators of the first row and subsequently the resonators of the second row and is decoupled at the output of the last resonator which is disposed directly adjacent the first resonator and in which the additional couplings are provided between the first and fourth filter circuits, between the fourth and ninth filter circuits, between the fifth and eighth filter circuits, and between the ninth and twelfth filter circuits.

2. The filter of claim 1, wherein said filter is a transit-time leveled band pass filter having two attenuation poles at predetermined finite frequencies, in each case below and above the pass band, and wherein said resonators are arranged in two juxtaposed rows which each contain three resonators, and wherein five additional couplings are provided.

3. The filter of claim 1, wherein said filter is a transit-time leveled band pass filter having two attenuation poles at predetermined finite frequencies, in each case below and above the pass band, and wherein said resonators are arranged in two juxtaposed rows which each contain three resonators, and wherein four additional couplings are provided.

4. The filter of claim 1, comprising a further coupling between the first and twelfth filter circuits.

* * * * *